US006273193B1

(12) United States Patent
Hermann et al.

(10) Patent No.: US 6,273,193 B1
(45) Date of Patent: Aug. 14, 2001

(54) DYNAMICALLY POSITIONED, CONCENTRIC RISER, DRILLING METHOD AND APPARATUS

(75) Inventors: Robert P. Hermann, Houston; Robert J. Scott, Sugarland; John M. Shaughnessy, Houston, all of TX (US)

(73) Assignee: Transocean Sedco Forex, Inc., Houston, TX (US)

( * ) Notice: Subject to any disclaimer, the term of this patent is extended or adjusted under 35 U.S.C. 154(b) by 0 days.

(21) Appl. No.: 09/212,250

(22) Filed: Dec. 16, 1998

Related U.S. Application Data

(60) Provisional application No. 60/069,718, filed on Dec. 16, 1997.

(51) Int. Cl.[7] ..... E21B 17/01

(52) U.S. Cl. ..... 166/359; 166/350

(58) Field of Search ..... 166/338, 340, 166/344, 345, 355, 358, 359, 350, 351, 352, 363, 367, 377; 175/5, 7; 114/264; 405/195.1, 203, 224.2, 224.4

(56) References Cited

U.S. PATENT DOCUMENTS

| | | | | |
|---|---|---|---|---|
| 3,191,201 | | 6/1965 | Richardson et al. | 441/3 |
| 3,279,404 | | 10/1966 | Richardson | 114/293 |
| 3,412,981 | | 11/1968 | Richardson | 254/106 |
| 3,612,176 | * | 10/1971 | Bauer | 166/359 |
| 3,628,336 | | 12/1971 | Moore et al. | 405/196 |
| 3,749,162 | * | 7/1973 | Anders | 114/264 X |
| 3,919,957 | | 11/1975 | Ray et al. | 114/265 |
| 3,982,492 | | 9/1976 | Steddum | 114/265 |
| 4,053,023 | | 10/1977 | Herd et al. | 175/7 |
| 4,059,148 | | 11/1977 | Blomsma | 166/359 |
| 4,265,568 | | 5/1981 | Herrmann et al. | 405/196 |
| 4,281,613 | | 8/1981 | Ray et al. | 114/230.23 |
| 4,431,059 | | 2/1984 | Blenkarn et al. | 166/359 |
| 5,439,060 | | 8/1995 | Huete et al. | 166/367 |
| 5,480,265 | | 1/1996 | Marshall et al. | 405/224.2 |
| 5,480,266 | | 1/1996 | Marshall et al. | 405/224 |
| 5,533,574 | | 7/1996 | Gonzalez | 166/358 |
| 5,588,781 | | 12/1996 | Smolinski et al. | 405/195.1 |
| 5,642,966 | | 7/1997 | Morrison et al. | 405/195.1 |
| 5,657,823 | * | 8/1997 | Kogure et al. | 166/340 |
| 5,706,897 | | 1/1998 | Horton, III | 166/359 |
| 5,727,640 | | 3/1998 | Gleditsch | 175/7 |
| 5,848,856 | * | 12/1998 | Moksvold | 175/7 |
| 6,042,303 | * | 3/2000 | Head | 405/195.1 |
| 6,085,851 | * | 7/2000 | Scott et al. | 175/7 |

OTHER PUBLICATIONS

"Drilling and Intervention Systems" brochure from MERCUR, No Date.

* cited by examiner

*Primary Examiner*—David Bagnell
*Assistant Examiner*—Sunil Singh
(74) *Attorney, Agent, or Firm*—Bradford E. Kile; Kile, Goekjian, Lerner & Reed, PLLC

(57) ABSTRACT

A dynamically positioned, concentric riser, drilling system comprising a dynamically positioned drilling unit operable to float at least partially above the surface of a body of water, a first, outer, low-pressure, marine riser extending from the drilling unit into the body of water, a tensioning system to support the first marine riser, a second, inner, high-pressure, marine riser concentrically extending within the first, outer, low-pressure, marine riser, a surface blowout preventor, a lower marine riser package, a subsea blowout preventor, and a connector at the base of the lower marine riser package to release the risers from the wellhead in the event of a loss of station of the drilling unit.

21 Claims, 2 Drawing Sheets

DYNAMICALLY POSITIONED, CONCENTRIC RISER, DRILLING METHOD AND APPARATUS

RELATED PATENT AND PROVISIONAL APPLICATION

This application is related to application Ser. No. 08/642,417, filed May 3, 1996, now U.S. Pat. No. 6,085,851, entitled "Multi-Activity Offshore Exploration and/or Development Drilling Method and Apparatus," of common assignment with the subject application. Additionally, this application is based on a provisional patent application Ser. No. 60/069,718, filed on Dec. 16, 1997, entitled "Concentric High-Pressure Riser For Deep Water Offshore Drilling" and priority is claimed.

BACKGROUND OF THE INVENTION

This invention relates to a novel method and apparatus for offshore drilling operations. More specifically, this invention relates to a method and apparatus for employing a concentric, high-pressure, marine riser in deep water offshore drilling where well depths have previously been restricted either because of a limitation of mud weights or because the hydrostatic head above the mud line does not allow drilling with a low margin between formation fracture pressure and pore pressure. Still further, this invention relates to gas handling in a long riser and safe well shut in, in the event of an unexpected loss of station of a dynamically positioned drilling unit.

In the past, substantial oil and gas reserves have been located beneath the Gulf of Mexico, the North Sea, the Beaufort Sea, the Far East regions of the world, the Middle East, West Africa, etc. In the initial stages of offshore exploration and/or development drilling, operations were conducted in relatively shallow water of a few feet to a hundred feet or so along the near shore regions and portions of the Gulf of Mexico. Over the years, the Gulf and other regions of the world have been extensively explored and known oil and gas reserves in shallow water have been identified and drilled. As the need for cost-effective energy continues to increase throughout the world, additional reserves of oil and gas have been sought in water depths of three to five thousand feet or more on the continental shelf. As an example, one actively producing field currently exists off the coast of Louisiana in two thousand eight hundred feet of water and drilling operations off New Orleans are envisioned in the near future in approximately three thousand to seven thousand five hundred feet of water. Still further, blocks have been leased in fields of ten thousand feet, and in the near future, it is anticipated that a desire will exist for drilling in twelve thousand feet of water or more.

Deep water exploration stems not only from an increasing need to locate new reserves, as a general proposition, but with the evolution of sophisticated three dimensional seismic imaging and an increased knowledge of the attributes of turbidities and deep water sands, it is now believed that substantial high production oil and gas reserves exist within the Gulf of Mexico and elsewhere in water depths of ten thousand feet or more. Although such formations offer substantial new opportunities, significant problems also exist.

Along the near shore regions and continental slope, oil reserves have been drilled and produced by utilizing fixed towers and mobile units such as jack-up platforms. Fixed towers or platforms are typically fabricated on shore and transported to a drilling site on a barge or self floating by utilizing buoyancy chambers within the tower legs. On station, the towers are erected and fixed to the seabed. A jack-up platform usually includes a barge or self-propelled deck that is used to float the rig to station. On site, legs at the corners of the barge or self-propelled deck are jacked down into the seabed until the deck is elevated a suitable working distance above a statistical storm wave height. An example of a jack-up platform is disclosed in Richardson U.S. Pat. No. 3,412,981. A jack-up barge is depicted in U.S. Pat. No. 3,628,336 to Moore et al.

Once in position fixed towers, jack-up barges and platforms are utilized for drilling through a short riser in a manner not dramatically unlike land based operations. It will readily be appreciated that although fixed platforms and jack-up rigs are suitable in water depths of a few hundred feet or so, they are not at all useful for deep water applications.

In deeper water, a jack-up tower has been envisioned wherein a deck is used for floatation and then one or more legs are jacked down to the seabed. The foundation of these jack-up platforms can be characterized into two categories: (1) pile supported designs and (2) gravity base structures. An example of a gravity base, jack-up tower is shown in United States Herrmann et al. U.S. Pat. No. 4,265,568. Again, although a single leg jack-up has advantages in water depths of a few hundred feet it is still not a design suitable for deep water sites.

For deep water drilling, semi-submersible platforms have been designed, such as disclosed in Ray et al. U.S. Pat. No. 3,919,957. In addition, tension leg platforms have been used such as disclosed in Steddum U.S. Pat. No. 3,982,492. A tension leg platform includes a platform and a plurality of relatively large legs extending downwardly into the sea. Anchors are fixed to the seabed beneath each leg and a plurality of permanent mooring lines extend between the anchors and each leg. These mooring lines are tensioned to pull partially the legs against their buoyancy, into the sea to provide stability for the platform. An example of a tension leg platform is depicted in Ray et al. U.S. Pat. No. 4,281,613.

In even deeper water sites, turret moored drillships and dynamically positioned drillships have been used. Turret moored drillships are featured in Richardson et al. U.S. Pat. Nos. 3,191,201 and 3,279,404.

A dynamically positioned drillship is similar to a turret moored vessel wherein drilling operations are conducted through a large central opening or moon pool fashioned vertically through the vessel amid ships. Bow and stern thruster sets are utilized in cooperation with multiple sensors and computer controls to maintain the vessel dynamically at a desired latitude and longitude station. A dynamically positioned drillship and riser angle positioning system is disclosed in Dean U.S. Pat. No. 4,317,174.

Each of the above referenced patented inventions is of common assignment with the subject application.

Notwithstanding extensive success in shallow to medium depth drilling, there is a renewed belief that significant energy reserves exist beneath water having depths of three thousand to twelve thousand feet or more. The challenges of drilling exploratory wells to tap such reserves, however, and follow on developmental drilling over a plurality of wells, are formidable. In this, it is believed that methods and apparatus existing in the past will not be adequate to economically address the new deep water frontier.

The present invention was conceived to facilitate offshore drilling in deep water. For purposes of this application, the term deep water is used to designate water having a depth of greater than two thousand, five hundred feet. The subject invention is also intended for use in ultra-deep water, that is, water having a depth greater than five thousand feet. This invention, however, should not be understood to exclude other depths of water. Specifically, the present invention can be successfully utilized in depths of water as shallow as two hundred feet. Throughout this description, the term deep water will be used to refer generally to deep water and ultra-deep water. Accordingly, deep water is any water having a depth greater than two thousand five hundred feet.

As drilling depths double and triple, drilling efficiency must be increased and/or new techniques envisioned in order to offset the high day rates that will be necessary to operate equipment capable of addressing deep water applications. Drillers have found areas in deep water, wherein the soil fracture gradient is often close to the pore pressure within a few thousand feet of the sea floor. These wells can be not be drilled with conventional equipment. Underbalanced drilling which has been successfully used onshore may be the only method to drill such formations. However, underbalanced drilling from a deep water floating drillship has not been possible because of limitations in a subsea rotating blowout preventor.

In addition to low margins between fracture and pore pressures and a need in some instances for underbalanced drilling, long riser strings in deep water present gas handling problems. Still further, with a dynamically positioned drillship, it is always a possibility that through one or more system failures position stability may be lost. For safety considerations, it is necessary to provide a rapid, fail-safe riser system to accommodate vessel drift within fifteen to thirty seconds of a failure event.

The difficulties suggested in the preceding are not intended to be exhaustive, but rather are among many which may tend to reduce the effectiveness and capacity to drill offshore from a drillship in deep water. Other noteworthy problems may also exist; however, those presented above should be sufficient to demonstrate that methods and systems for drilling in deep water from a dynamically positioned drillship will admit to worthwhile improvement.

OBJECTS OF THE INVENTION

It is therefore, a general object of the invention to provide a novel method and system for deep water drilling from a dynamically positioned floating unit.

It is another object of the invention to provide a novel method and apparatus for drilling in deep water having depths of two thousand five hundred feet to ten thousand feet or more, where margins are low between fracture and pore pressure of a subsea formation.

It is a specific object of the invention to provide a novel method and system for deep water underbalanced drilling from a dynamically positioned floating unit.

It is another specific object of the invention to provide a method and apparatus for using heavy mud while drilling deep holes from a dynamically positioned floating unit.

It is a further specific object of the invention to provide a method and system for drilling from a floating unit which is safe and suitable to quickly shut in a subsea well in the event of an unanticipated loss of station.

It is still a related object of the invention to provide a means for safe and effective quick disconnection of a dynamically positioned drilling unit.

THE DRAWINGS

Other objects and advantages of the present invention will become apparent from the following detailed description of a preferred embodiment thereof, taken in conjunction with the accompanying drawings, wherein.

DETAILED DESCRIPTION

Figure 1:
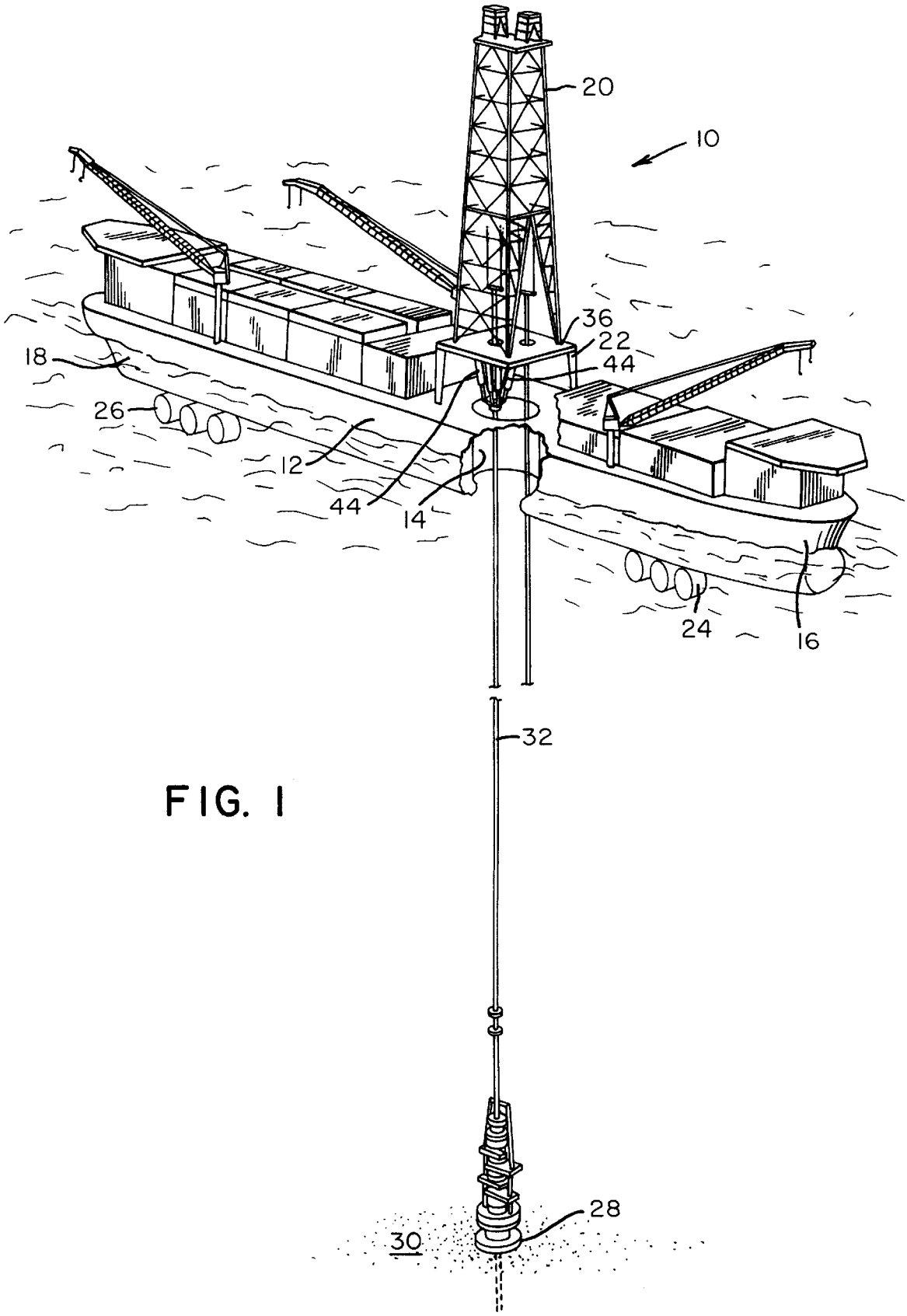
FIG. 1 is an axonometric view of a dynamically positioned drillship of the type that is suitable to advantageously conduct drilling operations in accordance with the subject invention.

Context of the Invention Referring now to the drawings, wherein like numerals indicate like parts, and initially to FIG. 1, there is shown an axonometric view of a dynamically positioned drillship with a central moon pool operable to receive drilling tubulars. A drillship of the type envisioned for use of the subject invention is disclosed and described in U.S. application for patent Ser. No. 08/642,417 entitled "Multi-Activity Offshore Exploration and/or Development Drilling Method and Apparatus" filed May 3, 1996, now U.S. Pat. No. 6,085,851. This application is of common assignment with the subject application and the disclosure of this application is incorporated by reference as though set forth at length. Briefly, however, the dynamically positioned drillship 10 comprises a tanker-type hull 12 which is fabricated with a large moon pool or opening 14 extending generally vertically between the bow 16 and stern 18 of the drillship. A multi-activity derrick 20 is mounted upon the drillship superstructure 22 above the moon pool 14 and is operable to conduct primary tubular operations and simultaneously operations auxiliary to primary drilling operations from the single derrick 20 through the moon pool 14.

In operation, the drillship 10 is maintained on station by being dynamically positioned. Dynamic positioning is performed by using a plurality of bow thrusters 24 and stern thrusters 26 which are accurately and dynamically controlled by on-board computers using input data to control the multiple degrees of freedom of the floating vessel in varying environmental conditions of wind, current, wave swell, etc. Dynamic positioning is relatively sophisticated and highly accurate. Utilizing satellites, dynamic positioning is capable of accurately maintaining a drillship at a desired latitude and longitude, and thus on station over a wellhead 28 at the seabed 30, within a matter of a foot or more.

Although a dynamically positioned drillship is disclosed and is a preferred method of conducting drilling operations in accordance with the subject inventive system, it is envisioned that in certain instances a dynamically positioned, semi-submersible may also be utilized as the primary drilling unit and thus drillships, semi-submersibles, and similar floating drilling units, which are dynamically positioned on station, are contemplated as a component of the subject invention.

Dynamically Positioned Subsea Drilling System

Figure 2:
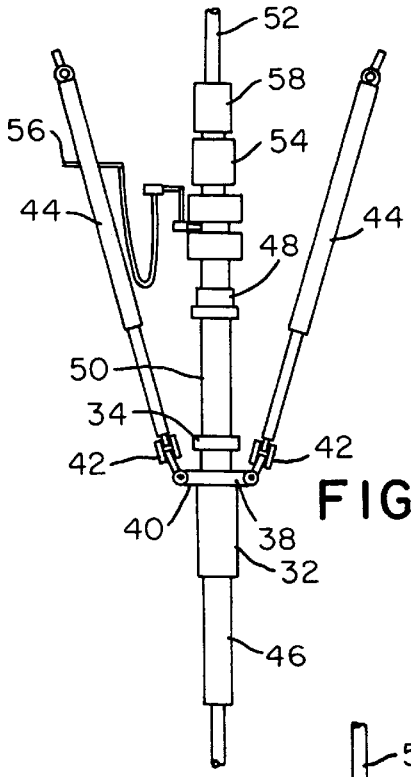
FIG. 2 is a schematic view of hydraulic tension and drilling unit components of a drilling system in accordance with the invention.

Referring again to FIG. 1, and in addition to FIG. 2, the subject dynamically positioned drilling system includes an outer marine riser 32 having an upper end terminating at a collar 34. The outer, low-pressure, marine riser 32 is typically twenty-one inches (21") in diameter and extends from the seabed 30 through an opening in the drillship, or moon pool 14, to a position beneath a drilling floor 36. The drilling floor is supported above the moon pool 14 by the derrick superstructure 22. In order to prevent the outer, low-pressure, marine riser 32 from collapsing during operations, a slip joint 38 is positioned about the low-pressure, marine riser 32 and includes an annular collar 40 which is operable to connect, via universal couplings 42, to a plurality of hydraulic tensioners 44.

The tensioners 44 are positioned uniformly about the slip joint 38 and are pivotally mounted beneath the deck 36 of the derrick and to components of the superstructure 22. The number and size of the hydraulic tensioners can vary, but in a preferred embodiment, six hydraulically cylinders are utilized and are equally spaced in sixty degree arcuate sites about the slip joint. The hydraulic tensioning units 44 are dynamically controlled in a conventional manner to maintain a constant tension upon the outer, low-pressure, marine riser 32. Although hydraulic cylinders 44 have been specifically disclosed and are preferred as tensioning devices, cable and winch systems are also envisioned. Such cable and winch systems may be utilized for casing tensioning either alone or in combination with hydraulic cylinders, as desired.

In addition to the outer, low-pressure, marine riser 32, the subject invention includes use of an inner, high-pressure, marine riser 46 which is typically thirteen and three-eighths inches (13⅜") in diameter and is coaxially positioned within the interior of the outer, marine riser 32. The inner, high-pressure, marine riser 46 terminates at its upper end at a load bearing ring 48 which cooperates with a cylindrical load shim 50 such that axial tension, which is applied to the outer, marine riser 32, is also transmitted, through the load shim 50, to the inner, marine riser 46.

A drill pipe 52 is lowered from the derrick 20 concentrically through the inner, high-pressure, marine riser to conduct subsea drilling operations through the concentric outer and inner, marine risers 32 and 46, respectively. A surface blowout preventor 54 is mounted on top of the inner, high-pressure, marine riser and includes a blooey line 56. Mounted upon the top of the blowout preventor 54 is a rotating head 58 containing inner and outer seals operable to receive the rotating drill pipe 52 and permit underbalanced drilling in a manner which will be discussed more fully below.

Figure 3:
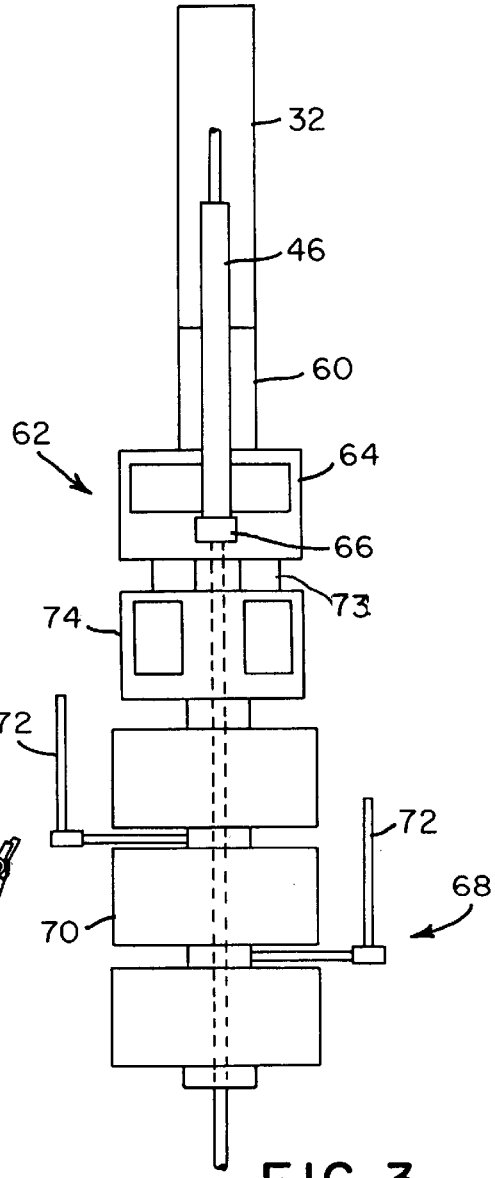
FIG. 3 illustrates a schematic view of components of the subject system at a wellhead location.

Referring now to FIG. 3, the outer riser 32 and inner riser 46 terminate through a flex joint 60 into a lower marine riser package 62. The lower marine riser package includes an upper annular member 64 and a connector 66 operable to join the inner, high-pressure, marine riser 46 with the lower marine riser package 62.

A subsea blowout preventor 68 extends beneath the lower marine riser package 62 and includes blowout preventors 70 comprising pipe rams and kill lines 72. The subsea blowout preventor is positioned between the wellhead and the lower marine riser package and is releasably joined by a connector 73. The riser connector 73 is operable to disconnect the lower marine riser package 62 with the first and second marine risers from the subsea blowout preventor 68 in the event of an emergency loss of drillship station. In addition to the connector 73, shear rams 74 are mounted at the upper most portion of the blowout preventor 68 and serve to shut in the well in the event of an emergency drive-off.

Figure 4:
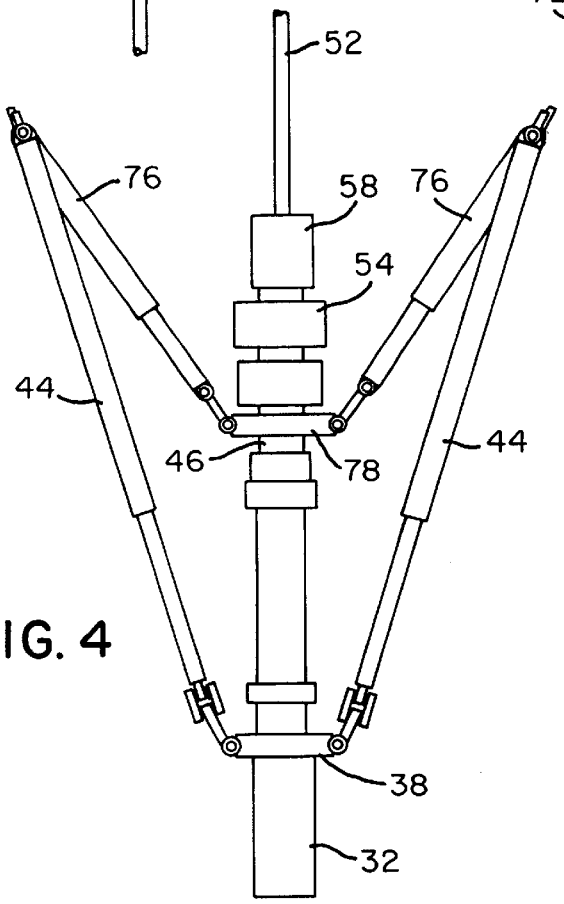
FIG. 4 is an alternate preferred embodiment of the hydraulic tensioning and drilling unit components of the drilling system depicted in FIG. 2.

In one embodiment of the invention, axial tensioning of the concentric risers 46 and 32 is provided by a single system of hydraulic tensioners 44. Turning to FIG. 4, there will be seen an alternative, preferred embodiment of the invention wherein the hydraulic tensioners 44, which are connected to the slip ring 38 and thus serve to carry both the inner and outer, marine risers, are supplemented by an independent hydraulic tensioning system including opposing hydraulic tensioners 76. These independent tensioners are secured at one end to the drilling platform superstructure and at the other end to an annular collar 78, positioned about an upper end of the interior, high-pressure, marine riser 46. This independent tensioning system is depicted as a pair of opposing hydraulic tensioners, however, additional tensioners may be utilized in a symmetric pattern. Alternatively, two or more balanced winch and cable assemblies may be used to impart independent tension to the high-pressure, marine riser. The purpose of this independent tensioning function is to supplement dynamic tensioning of the inner, high-pressure, marine riser and accommodate axial elongation of the inner, high-pressure, marine riser with respect to the outer, low-pressure, marine riser during a drilling operation.

OPERATIONAL EXAMPLE AND ADVANTAGES OF THE INVENTION

To illustrate the potential benefits of the subject invention, consider a well in sixty-five hundred feet of water. After setting fifteen hundred feet of twenty inch (20") conductor casing and landing the subsea blowout preventor a sixteen inch (16") casing string would be run in the riser. A fourteen and three-quarters inch (14¾") bit and twenty inch (20") underreamer would be run together to drill the next interval. The drillship is equipped with four twenty-two hundred horsepower, seventy-five hundred psi mud pumps and six and five-eighths inch (6⅝") drill pipe to ensure that adequate drilling hydraulics can be achieved. A boost pump may not be needed because the annular velocity has increased 290% in the thirteen and five-eighths inch (13⅝") casing compared to the marine riser.

While simultaneously drilling and underreaming the mud, weight would be gradually increased to within 0.4 pound per gallon (ppg) of the shoe test. Drilling parameters would be monitored until there was evidence of a pore pressure increase. The high-pressure, marine riser 46 and surface blowout preventor 54 provide many advantages in this situation compared to standard deep water operations.

These advantages include: (1) an improved ability to handle gas; (2) conventional kick circulation is faster, more efficient and less complicated than going through a subsea blowout preventor and choke and kill lines; (3) no gas is trapped in the subsea blowout preventor that needs to be removed; (4) there is less potential to form hydrates; and (5) an ability to work pipe while shut-in at the surface blowout preventor where leaks can be immediately detected and worn elements can be easily replaced.

After reaching TD of ten thousand feet, three thousand feet of the high-pressure casing riser can be pulled to the surface. At that depth, a subsea hanger and seal assembly would be made up to the remaining casing. Then, the remaining thirty-five hundred feet of casing can be run to TD. It would not be necessary to pull and stand back the entire casing string. In order to drill with casing, the shoe joints are designed with landing shoulders to latch a cement wiper plug. The casing OD would be increased so that there would not be an internal restriction.

If upon reaching the casing point in the example above the hole is near or slightly underbalanced the well could be balanced by circulating dual weight fluids into the hole. A combination of seawater and heavier mud would balance the TD pore pressure without exceeding the fracture gradient of the shoe. The fracture pressure at the shoe would actually be less than when pressure was trapped (under the surface blowout preventor) on a uniform column of mud.

The following table summarizes a plot of pore pressure, mud weight, and fracture gradient for a recent deep water well. A 0.5 ppg margin was assumed between the mud weight at the next casing point and the fracture pressure at the previous shoe. If the high-pressure concentric riser is utilized to allow drilling the top hole clays with little margin the casing program would be revised.

| Casing | Setting Depth | Fracture Point | MW @ next Casing Point |
|---|---|---|---|
| | | Example Well Plan | |
| 20" | 9,100' | 10.3 ppge | 9.8 ppge |
| 13⅜" | 10,900' | 11.4 ppge | 10.9 ppge |
| 9⅝" | 12,600' | 12.5 ppge | 11.8 ppge |
| | | Extended Casing Point Example | |
| 20" | 9,100' | 10.3 ppge | 10.1 ppge |
| 13⅜" | 11,400' | 11.7 ppge | 11.3 ppge |
| 9⅝" | 13,400' | 12.8 ppge | 11.8 ppge |

(ppge represents pound per gallon equivalent)

Getting the intermediate casing deeper provides a greater margin when drilling the objective horizons conventionally without the high-pressure, marine riser. Stretching the top hole casing points would have more impact in wells where the pore pressure increases more quickly.

After reading and understanding the foregoing description of a preferred embodiment of the invention, in conjunction with the illustrative drawings, it will be appreciated that several distinct advantages of the subject concentric high-pressure, marine riser method and apparatus are obtained.

Without attempting to set forth all of the desirable features and advantages of the instant method and apparatus, at least some of the major advantages of the invention are detailed below.

Primarily, the use of a higher pressure, marine riser run inside a conventional marine drilling riser provides floating rigs with some advantages enjoyed by fixed rigs: the potential to drill underbalanced or near balanced, improved gas handling capability, improved well testing capability, expanded kick control capabilities, and increased mud weight rating.

Primary advantages of underbalanced drilling are minimized reservoir damage, increased rate of penetration, and reduced stuck pipe due to reduced overbalance. The incentive to drill underbalanced in deep water includes an ability to drill with a reduced margin between pore pressure and the fracture pressure at the last casing shoe. The target horizons for considering underbalanced drilling are between fifteen hundred feet and five thousand feet below the mud line. Multiple casing strings can be required in this interval because the difference between fracture gradient and pore pressure can be less than one pound per gallon equivalent. Use of a high-pressure concentric riser and surface blowout preventor would allow drilling with reduced margin through generally non-permeable clays. If each casing string were deepened a few hundred feet, it could make a significant difference in the casing size available at TD. Thus, the deep water incentive for drilling underbalanced is different than land, ROP is not a problem and the productive horizons are not applications of this technology.

Gas handling at the surface would be greatly improved with a high-pressure concentric riser. Currently, gas in the marine riser must be allowed to divert uncontrolled. A surface blowout preventor on a high-pressure, marine riser would allow that gas to be circulated out while its expansion is controlled.

The high-pressure, marine riser would be advantageous for use with a dual density system. Nitrogen can be injected into the mud at the seafloor to reduce the hydrostatic pressure on the formation. Due to the dual density, the effective mud gradient at the shoe is less than the effective gradient at the bottom of the hole. A major disadvantage of this method would be identifying and controlling a kick. By using a high-pressure, marine riser, kick control would be significantly improved because the riser could be controlled at any time.

Well testing is another area where a high-pressure, marine riser and surface blowout preventor could improve efficiency. The test string currently run from floating rigs allows for shut in at the reservoir and shut-in and disconnect at the seafloor in the subsea blowout preventor in the event an emergency disconnect of the riser is required. On a surface drilling system, a control head (tree) is run above the blowout preventor stack to control the flow.

Well control in deep water presents additional problems. Friction losses in choke and kill lines aggravate the difficulties encountered with typical low margins between pore pressure and fracture gradient. Uncontrolled gas volumes above the subsea blowout preventor can overwhelm surface gas handling capabilities and lead to explosion or fire at a rig. Use of a high-pressure, marine riser and surface blowout preventor can diminish both of these problems. Gas inside the riser is contained and the inner pipe can act as a super-diameter choke line and eliminate problems with high friction losses.

The inner riser arrangement allows drilling with heavy mud. Up to 20# mud can be accommodated in thirteen and three-eighths inch (13⅜") riser without any increase in riser tension. In this, the weight per foot of thirteen and three-eighths inch (13⅜") riser filled with 20# mud is less than a twenty-one inch (21") riser filled with 17# mud. Moreover, the thirteen and three-eighths inch (13⅜") string also provides structural stiffness lacking in the mud only case. The smaller volume also reduces mud costs.

The biggest safety issue with pressure risers concerns securing the well in the event of an emergency disconnect. A dynamic positioning operation requires the capability that the well be immediately secured and the lower marine riser package disconnected during a drive-off. Although rare, this can occur at any time. By terminating the high-pressure, marine riser in the lower marine riser package it is possible to use all of the existing safety procedures for such an emergency disconnect. The inner riser simply becomes an internal part of the marine riser and both act together when the lower marine riser package is unlatched. Because the inner riser is above the blowout preventor there is nothing inside the stack to interfere with the normal emergency disconnect sequence. The casing string is tied back to the lower marine riser package either by closing the annular preventer on a shoe at the bottom of the string or using a standard production riser tie back connector. The tie back connector has the advantage of providing a metal-to-metal seal but requires that internal profile be cut or otherwise provided somewhere in the lower marine riser package above the connector. In the event of an emergency disconnect the concentric riser will remain latched in the lower marine riser package.

In order to minimize the time lost in running and retrieving the inner string, a liner could of course be set through the inner riser without first recovering the string and drilling continued after cementing. Because new drilling rigs such as the deep water drillship identified above can make up and stand back one hundred twenty-five feet stands of casing with the offline rig then some of this lost time is avoided.

Moreover, it is possible to eliminate altogether the lost rig time by using this same pipe as the next downhole casing string. In this instance, after underreaming to TD, the blowout preventor is nippled down, the inner string released, pipe added or removed as needed, and the seal assembly made up. The string is then run to bottom and cemented using a special plug. The high capacity mud pumps on new deep water rigs should allow drilling and underreaming at the same time without trouble.

In sum, on the new generation of drillships the high-pressure concentric riser can be run in a cost effective manner. It would improve the safety of gas handling above the seafloor and permit a new approach utilizing injected gas to effect a dual density drilling. It also has the potential to simplify planning and hardware needed for production testing. The well construction can be improved by permitting top hole to be drilled more safely with a reduced mud weight margin. This may permit drilling certain areas that can not be drilled with current technology.

In describing the invention, reference has been made to preferred embodiments and illustrative advantages of the invention. In particular, a large, tanker dimension drillship 30 has been specifically illustrated and discussed which is the presently envisioned preferred embodiment. It will be appreciated, however, by those of ordinary skill in the art, that the subject single derrick with multi-rotary structure may be advantageously utilized by other offshore platform systems such as jack-ups, semi-submersibles, tension leg platforms, fixed towers, and the like, without departing from the subject invention. Those skilled in the art, and familiar with the instant disclosure of the subject invention, may also recognize other additions, deletions, modifications, substitutions, and/or other changes which will fall within the purview of the subject invention and claims.

What is claimed is:

1. A dynamically positioned, concentric riser, drilling system comprising:

a drilling unit operable to float at least partially above the surface of a body of water and being dynamically positioned to maintain station above a subsea well to be drilled into the seabed, said drilling unit having an opening extending through the unit to permit drilling from the drilling unit, through the opening and into the seabed;

a first marine riser extending from the drilling unit, through the opening in the unit, and to the bed of the body of water for supporting drilling operations into the seabed;

a tensioning system extending between structure of said drilling unit and an upper end of said first marine riser for supporting said first marine riser through the opening and into the body of water to the subsea well hole;

a second marine riser having a smaller diameter and higher pressure rating than said first marine riser and concentrically extending within said first marine riser from said drilling unit to the seabed for supporting drilling operations from said dynamically positioned drilling unit into the seabed;

a surface blowout preventor mounted upon the upper end of said second marine riser for facilitating drilling and gas pressure control within said second marine riser;

means for connecting the upper end of said second marine riser to the upper end of said first marine riser such that said first marine riser operably supports said second marine riser from said drilling unit;

a lower marine riser package positioned at a lower end of said first marine riser, said lower marine riser package includes a connector connecting the second marine riser to said lower marine riser package;

a subsea blowout preventor positioned at the subsea well head; and a connector positioned at the base of said lower marine riser package and above said subsea blowout preventor and being operable to release the risers from the well head below the lower marine riser package and to close in the well above the subsea blowout preventor in the event of loss of station of the dynamically positioned drilling unit.

2. A dynamically positioned, concentric riser, drilling system as defined in claim 1 wherein said tensioning system comprises:

a plurality of hydraulic ram assemblies spaced equally about an upper end of said first marine riser and extending from a slip joint about said first marine riser to radial locations connected to the drilling unit wherein dynamic tension is applied from the drilling unit to the first marine riser by said plurality of hydraulic ram assemblies.

3. A dynamically positioned, concentric riser, drilling system as defined in claim 2 and further comprising:

a cylindrical load shim coaxially extending about an upper end of said second marine riser between a load ring mounted at the upper end of the second marine riser and a load ring at an upper end of said first marine riser such that tension applied to said first marine riser by said plurality of hydraulic ram assemblies concomitantly is used to carry said second marine riser.

4. A dynamically positioned, concentric riser, drilling system as defined in claim 3 and further comprising:

a plurality of hydraulic ram assemblies extending between the drilling unit from a position adjacent the opening and the upper end of said second marine riser to dynamically apply tension to said second marine riser independently of said first marine riser.

5. A dynamically positioned, concentric riser, drilling system as defined in claim 4 and further comprising:

a rotating head positioned above said surface blowout preventor to accommodate underbalanced drilling operations through said second, high-pressure marine riser.

6. A dynamically positioned, concentric riser, deep water, drilling system comprising:

a drillship operable to float upon the surface of a body of water and being dynamically positioned on station above a subsea well to be drilled into the seabed, said drillship having a moon pool extending through the hull to permit drilling from the drillship through the moon pool and into the seabed;

a first marine riser extending from the drillship, through the moon pool, and to the bed of the body of water for supporting drilling operations into the seabed;

a tensioning system extending between structure mounted on said drillship and an upper end of said first marine riser for supporting said first marine riser through the moon pool and into the body of water down to a well hole;

a second marine riser having a higher pressure rating than said first marine riser and concentrically extending within said first marine riser from said drillship to the seabed for supporting drilling operations from said dynamically positioned drillship into the seabed including formations where pore pressure and the formation fracture gradient are similar;

a surface blowout preventor mounted upon the upper end of said second marine riser for facilitating drilling and gas pressure control within said second marine riser;

means for connecting the upper end of said second marine riser to the upper end of said first marine riser such that said first marine riser operably supports said second marine riser from said drillship;

a lower marine riser package positioned at a lower end of said first marine riser, said lower marine riser package includes a connector connecting the second marine riser to said lower marine riser package;

a subsea blowout preventor positioned at a subsea wellhead; and a connector positioned at the base of said lower marine riser package and above said subsea blowout preventor and being operable for release of the risers from the subsea wellhead below the lower marine riser package, and means positioned beneath the connector to close the well in the event of loss of station of the drillship and wherein drilling in deep water may be safely performed from a dynamically positioned drillship.

7. A dynamically positioned, concentric riser, deep water, drilling system as defined in claim 6 wherein said tensioning system comprises:

a plurality of hydraulic ram assemblies spaced equally about an upper end of said first marine risers and extending from a slip joint about said first marine riser to radial locations connected below a superstructure of the drillship positioned above the moon pool wherein dynamic tension is applied from the drillship to the first marine riser by said plurality hydraulic ram assemblies.

8. A dynamically positioned, concentric riser, deep water, drilling system as defined in claim 7 and further comprising:

a cylindrical load shim coaxially extending about an upper end of said second marine riser between a load ring mounted at the upper end of the second marine riser and a load ring at an upper end of said first marine riser such that tension applied to said first marine riser by said plurality of hydraulic ram assemblies will be used to carry said second marine riser through said load rings and said load shim between the upper end of the first riser and the upper end of said second riser.

9. A dynamically positioned, concentric riser, deep water, drilling system as defined in claim 8, and further comprising:

a rotating head positioned above the surface blowout preventor to accommodate underbalanced drilling operations through said second, high-pressure marine riser.

10. A dynamically positioned, concentric, deep water, drilling system as defined in claim 8, wherein said lower marine riser package further includes:

an upper annular member and a flex joint connected to a subsea portion of said first marine riser.

11. A dynamically positioned, concentric riser, deep water, drilling system as defined in claim 8 and further comprising:

shear rams positioned above said subsea blowout preventor.

12. A dynamically positioned, concentric riser, deep water, drilling system as defined in claim 7 and further comprising:

a plurality of hydraulic ram systems extending between superstructure of the drillship positioned above the moon pool and the upper end of said second marine riser to dynamically apply tension to said second marine riser independently of said first marine riser.

13. A dynamically positioned, concentric riser, deep water, drilling system as defined in claim 12, and further comprising:

a rotating head positioned above the surface blowout preventor to accommodate underbalanced drilling operations through said second, high-pressure marine riser.

14. A dynamically positioned, concentric riser, deep water, drilling system as defined in claim 12, wherein said lower marine riser package further includes:

an upper annular member and a flex joint connected to a subsea portion of said first marine riser.

15. A dynamically positioned, concentric riser, deep water, drilling system as defined in claim 12 and further comprising:

shear rams positioned above said subsea blowout preventor.

16. A dynamically positioned, concentric riser, deep water, drilling system as defined in claim 6 and further comprising:

a rotating head positioned above the surface blowout preventor to accommodate underbalanced drilling operations through said second, high-pressure marine riser.

17. A dynamically positioned, concentric riser, deep water, drilling system as defined in claim 6 wherein said lower marine riser package further includes:

an upper annular member and a flex joint connected to a subsea portion of said first marine riser.

18. A dynamically positioned, concentric riser, deep water, drilling system comprising:

a drillship operable to float upon the surface of a body of water and being dynamically positioned on station above a subsea well to be drilled into the seabed, said drillship having a moon pool extending through the hull to permit drilling from the drillship through the moon pool and into the seabed;

a first marine riser extending from the drillship, through the moon pool, and to the bed of the body of water for supporting drilling operations into the seabed;

a smaller diameter, second marine riser having a higher pressure rating than said first marine riser and concentrically extending within said first marine riser from said drillship to the seabed for supporting underbalanced drilling operations from said dynamically positioned drillship into the seabed including formations where pore pressure and the formation fracture gradient are similar;

a tensioning system extending between structure mounted on said drillship and an upper end of said first marine riser for supporting said first marine riser through the moon pool and into the body of water down to the well hole including:

a first plurality of hydraulic ram assemblies spaced equally about an upper end of said first marine risers and extending from a slip joint about said first marine riser to radial locations upon a superstructure of the drillship positioned above the moon pool wherein dynamic tension is applied from the drillship to the first marine riser by said plurality hydraulic ram assemblies;

a cylindrical load shim coaxially extending about an upper end of said second marine riser between a load ring mounted at the upper end of the second marine riser and a load ring at an upper end of said first marine riser such that tension applied to said first marine riser by said plurality of hydraulic ram assemblies will be used to carry said second marine riser through said load rings and said load shim between the upper end of the first riser and the upper end of said second riser;

a second plurality of hydraulic ram assemblies extending between superstructure of the drillship positioned above the moon pool and the upper end of said second marine riser to dynamically apply tension to said second marine riser independently of said first marine riser;

a surface blowout preventor and a rotating head to accommodate underbalanced drilling operations through said second marine riser, mounted upon the upper end of said second marine riser for facilitating underbalanced drilling and gas pressure control within said second marine riser;

a lower marine riser package positioned at the seabed, said lower marine riser package including:

riser connectors operable to connect said first and second marine risers to said lower marine riser package;

a subsea blowout preventor positioned below said lower marine riser package; and a connector operable to connect said lower marine risers to said subsea blowout preventor, said subsea blowout preventor being operable to close the well in the event of loss of station of the drillship and release of the risers from the well head at the lower marine riser package, wherein underbalanced drilling in deep water may be safely performed from a dynamically positioned drillship.

19. A method for drilling with a dynamically positioned, concentric riser system in deep water, said method comprising the steps of:

dynamically positioning a drillship above a wellhole to be drilled;

extending a first, low-pressure, marine riser through a moon pool in the drillship to a subsea wellhead;

connecting the submerged end of the first, low-pressure, marine riser to a lower marine riser package;

concentrically positioning a second, higher pressure, marine riser within the first, low-pressure, marine riser from the drillship to the lower marine riser package;

connecting the lower marine riser package to a subsea blowout preventor positioned above the subsea wellhead;

tensioning the first, low-pressure, marine riser from the drillship to provide operative support for the first, low-pressure, marine riser above the wellhole;

supporting an upper end of the concentric, higher pressure, marine riser upon an upper end of the first, low pressure, marine riser; and providing a rotatable blowout preventor system at an upper end of the concentric, higher pressure, inner riser for conducting underbalanced drilling operations through the second, higher pressure, marine riser.

20. The method for drilling with a dynamically positioned, concentric riser, system in deep water as defined in claim 19, wherein said step of tensioning further comprises:

independently tensioning said second, high-pressure, marine riser from the drillship to maintain a constant tension in both said first, low-pressure, marine riser and said second, high-pressure, marine riser notwithstanding elongation of said second, high-pressure, marine riser with respect to said first, low-pressure, marine riser.

21. The method for drilling with a dynamically positioned drillship in deep water as described in claim 19, wherein, in the event of loss of station by the dynamically positioned drillship, said method further comprises the steps of:

severing connection of said lower marine riser package with said subsea blowout preventor; and concomitantly closing in the well at the subsea blowout preventor.

* * * * *

UNITED STATES PATENT AND TRADEMARK OFFICE

CERTIFICATE OF CORRECTION

PATENT NO. : 6,273,193 B1
DATED : August 14, 2001
INVENTOR(S) : Hermann et al.

It is certified that error appears in the above-identified patent and that said Letters Patent is hereby corrected as shown below:

Column 3,
Line 18, delete “be” in the first instance following “can.”

Column 4,
Line 16, “Context of the Invention” should be a subtitle.
Line 17, the word “Referring” should begin a paragraph.

Column 5,
Line 11, delete “hydraulically” and insert -- hydraulic --.

Column 8,
Line 12, delete “shut in” and insert -- shut-in --.

Column 11,
Line 50, after “concentric”, insert -- riser --.

Column 12,
Line 2, following “claim” delete “12, and further comprising”, and insert -- 8, wherein said lower marine riser package further includes: --.
Lines 4 to 7, delete lines 4 to 7, and insert -- an upper annular member and a flex joint connected to a subsea portion of said first marine riser. --
Lines 9 and 10, following “claim” delete “12, wherein said lower marine riser package further includes:” and insert -- 8 and further comprising: --.
Lines 11 and 12, delete lines 11 and 12, and insert -- shear rams positioned above said subsea blowout preventor --.
Line 14, following “claim”, delete “12”, and insert -- 9 and further comprising --.
Lines 16 and 17, delete lines 16 and 17, and insert -- a rotating head positioned above the surface blowout preventor to accommodate underbalanced drilling operations through said second, high-pressure marine riser --.
Lines 19 and 20, following “claim”, delete “6 and further comprising:” and insert -- 9, wherein said lower marine riser package further includes: --
Lines 21-24, delete lines 21 to 24, and insert -- an upper annular member and a flex joint connected to a subsea portion of said first marine riser. --
Lines 29-30, delete lines 29 and 30, and insert -- shear rams positioned above said subsea blowout preventor --.
Line 62, following “said plurality” insert -- of --.

UNITED STATES PATENT AND TRADEMARK OFFICE

CERTIFICATE OF CORRECTION

PATENT NO. : 6,273,193 B1
DATED : August 14, 2001
INVENTOR(S) : Hermann et al.

It is certified that error appears in the above-identified patent and that said Letters Patent is hereby corrected as shown below:

Column 14,
Line 21, following "riser" delete ",".

Signed and Sealed this

Twenty-sixth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,273,193 B1
DATED : August 14, 2001
INVENTOR(S) : Hermann et al.

It is certified that error appears in the above-identified patent and that said Letters Patent is hereby corrected as shown below:

Column 3,
Line 18, delete “be” in the first instance following “can.”

Column 4,
Line 16, “Context of the Invention” should be a subtitle.
Line 17, the word “Referring” should begin a paragraph.

Column 5,
Line 11, delete “hydraulically” and insert -- hydraulic --.

Column 8,
Line 12, delete “shut in” and insert -- shut-in --.

Column 11,
Line 50, after “concentric”, insert -- riser --.

Column 12,
Line 62, following “said plurality” insert -- of --.

Column 14,
Line 21, following “riser” delete “,”.

This certificate supersedes Certificate of Correction issued November 26, 2002.

Signed and Sealed this

Ninth Day of December, 2003

JAMES E. ROGAN
*Director of the United States Patent and Trademark Office*